US009194639B1

(12) United States Patent
Malheiros et al.

(10) Patent No.: US 9,194,639 B1
(45) Date of Patent: Nov. 24, 2015

(54) DUAL SEAR TRIGGER ASSEMBLY WITH CENTERED INTERLOCK

(71) Applicant: Crosman Corporation, Bloomfield, NY (US)

(72) Inventors: George Wallace Rodrigues Malheiros, Victor, NY (US); Justin Heckert, Rochester, NY (US)

(73) Assignee: Crosman Corporation, Bloomfield, NY (US)

( * ) Notice: Subject to any disclaimer, the term of this patent is extended or adjusted under 35 U.S.C. 154(b) by 0 days.

(21) Appl. No.: 14/542,114

(22) Filed: Nov. 14, 2014

(51) Int. Cl.

| | |
|---|---|
| ***F41A 19/32*** | (2006.01) |
| ***F41A 19/12*** | (2006.01) |
| ***F41A 19/10*** | (2006.01) |
| ***F41A 19/42*** | (2006.01) |

(52) U.S. Cl.
CPC ..... *F41A 19/12* (2013.01); *F41A 19/10* (2013.01); *F41A 19/32* (2013.01); *F41A 19/42* (2013.01)

(58) Field of Classification Search
CPC ..... F41A 19/10; F41A 19/12; F41A 19/13; F41A 19/14; F41A 19/31; F41A 19/1932
USPC ..... 42/69.02, 69.03; 89/147
See application file for complete search history.

(56) References Cited

U.S. PATENT DOCUMENTS

| | | | | |
|---|---|---|---|---|
| 2,551,370 | A * | 5/1951 | Gartner | 42/69.02 |
| 5,386,659 | A * | 2/1995 | Vaid et al. | 42/69.02 |
| 8,490,310 | B2 | 7/2013 | Torre | |
| 8,966,802 | B1 * | 3/2015 | Findlay | 42/69.01 |

OTHER PUBLICATIONS

Spencer: "Trigger Function and Terminology" http://home.insightbb.com/~bspen/triggerterm.html [Oct. 16, 2014 10:14:42 am].
Offgrid Survival: Firearm Basics: Basic Parts of a Gun website http://offgridsurvival.com/basicpartsofagun/[Oct. 16, 2014 10:03:57 am].

* cited by examiner

*Primary Examiner* — Stephen M Johnson
(74) *Attorney, Agent, or Firm* — Brian B. Shaw, Esq.; Harter Secrest & Emery LLP

(57) ABSTRACT

A trigger assembly cooperates with a planar interlock, wherein the plane of the interlock includes a longitudinal axis of the barrel in a break barrel airgun. The trigger assembly includes a primary sear and a secondary sear, wherein the secondary sear is contacted by the interlock during cocking of the airgun. The contact of the interlock and the secondary sear is independent of a position of a safety in the trigger assembly.

9 Claims, 11 Drawing Sheets

DUAL SEAR TRIGGER ASSEMBLY WITH CENTERED INTERLOCK

CROSS-REFERENCE TO RELATED APPLICATIONS

Not Applicable.

STATEMENT REGARDING FEDERALLY SPONSORED RESEARCH OR DEVELOPMENT

Not Applicable.

THE NAMES OF THE PARTIES TO A JOINT RESEARCH AGREEMENT

Not Applicable.

REFERENCE TO A "SEQUENCE LISTING"

Not Applicable.

STATEMENT REGARDING PRIOR DISCLOSURES BY THE INVENTOR OR A JOINT INVENTOR

Not Applicable.

BACKGROUND

1. Field

The present disclosure generally relates to a trigger assembly for a gun, and more particularly to a trigger assembly for a break barrel airgun, wherein a substantially planar interlock is aligned with a longitudinal axis of a gun barrel selectively engages a secondary sear in the trigger assembly.

2. Description of Related Art

U.S. Pat. No. 8,490,310 discloses a trigger mechanism for a sporting rifle having a rigid profile and a trigger safety catch and, because it also has a wall firmly attached to the rigid profile, which comprises the trigger and safety catch on one of the faces of said wall and similarly with the other face free, a first stud firmly attached to the trigger, a cover that partially covers the trigger and safety catch and the cover consists of an aperture, in the form of a slider, allowing the first stud to pass through it and for the movement of said first stud along the length of said aperture and a slider arranged over the cover in which, with the barrel broken, the referred slider will block the movement of said stud along the length of the aperture, thus immobilizing the trigger and, in the closed barrel position, the mentioned slider allows the movement of the first stud along the aperture.

However, the need remains for a trigger assembly that has reduced manufacturing requirements and hence cost. The need also exists for a trigger assembly that can be employed in a break barrel airgun, wherein the trigger assembly includes a primary sear and a secondary sear.

BRIEF SUMMARY

The present disclosure includes a trigger assembly having a housing with first and second spaced opposing side walls, a trigger and a safety at least partially located between the opposing side walls, a primary sear and a secondary sear located between the opposing side walls, wherein the secondary sear rotates about a pivot between a safety position and a release position, wherein the primary sear includes a first contact surface and a spaced apart second contact surface and the secondary sear includes a first guide surface and a second guide surface, the first contact surface contacting the first guide surface and the second contact surface contacting the second guide surface; and an interlock extending between the opposing side walls, the interlock moveable between (i) an interlocked position contacting the secondary sear to at least one of (a) inhibit, restrict or preclude a firing movement of the secondary sear and (b) urge movement of the secondary sear to the safety position and (ii) a shooting position permitting movement of the secondary sear to the release position.

BRIEF DESCRIPTION OF THE SEVERAL VIEWS OF THE DRAWING(S)

DETAILED DESCRIPTION

Figure 1:
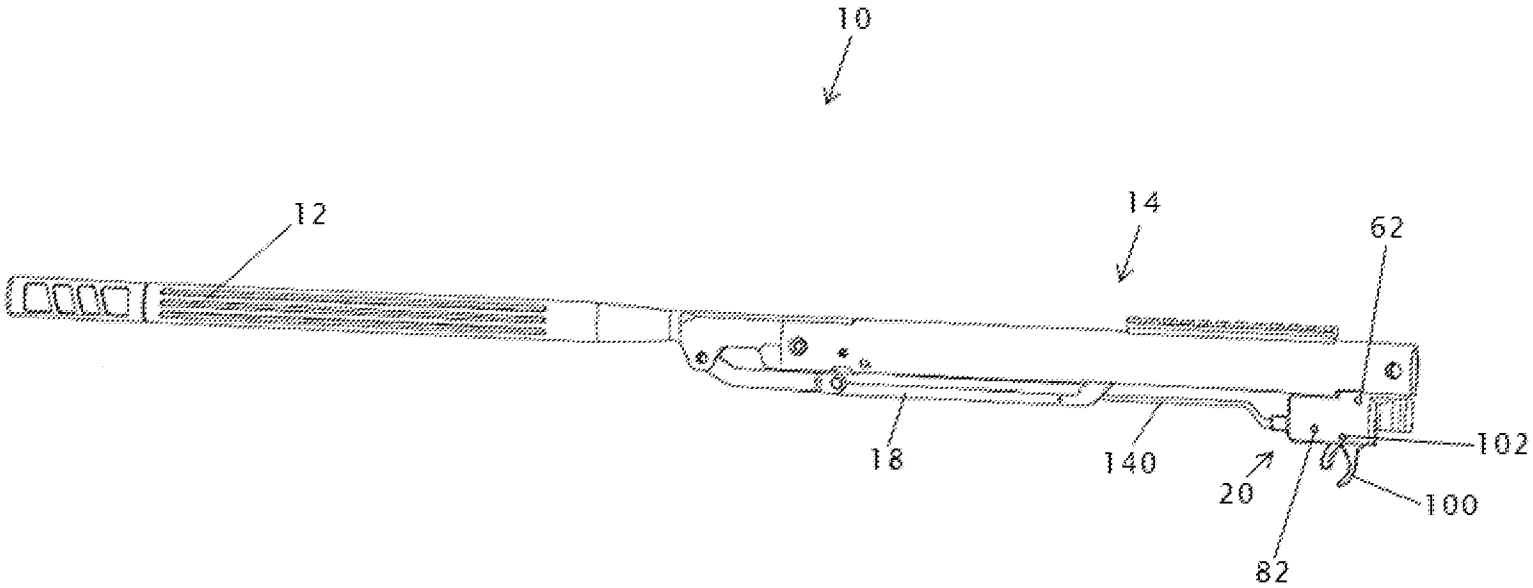
FIG. 1 is a side elevational view of a barrel and trigger assembly for an airgun having the present trigger assembly.

As seen in FIG. 1, an assembly 10 for an airgun includes a trigger assembly 20. In one configuration, the airgun is a break barrel airgun (sometimes referred to as a break action rifle or gun). The assembly 10 has an elongate barrel 12 extending along a longitudinal axis, wherein the airgun includes a receiver portion.

Figure 7:
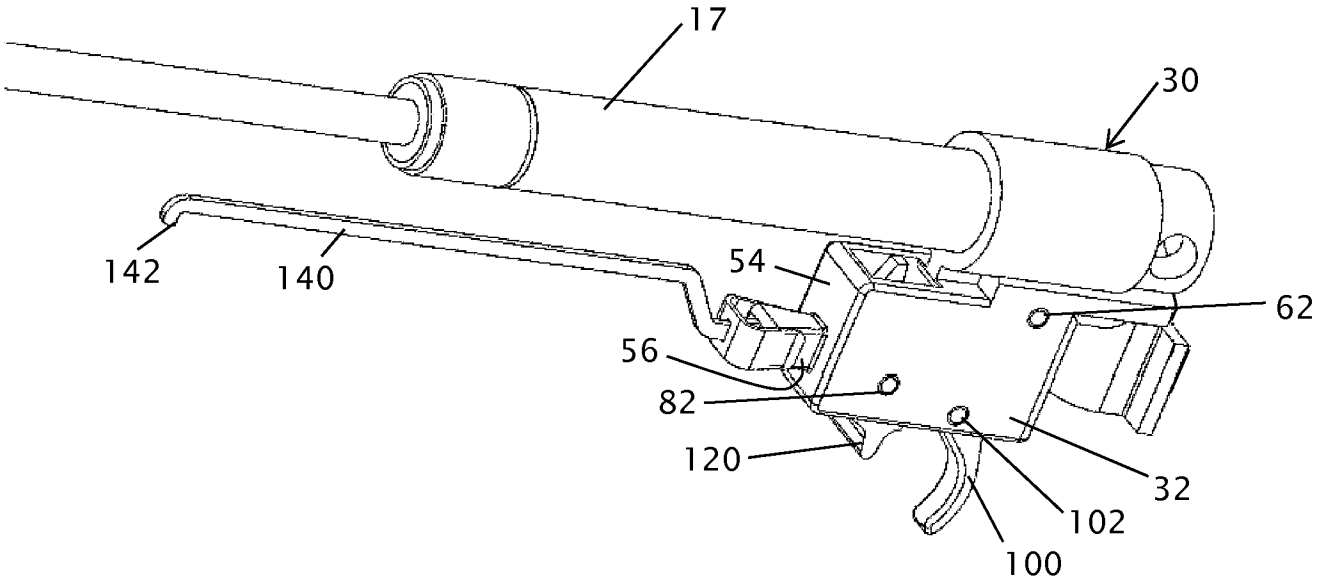
FIG. 7 is a perspective view of the portion of the assembly of FIG. 3 showing a configuration of the trigger assembly and interlock in a fired configuration.
Figure 8:
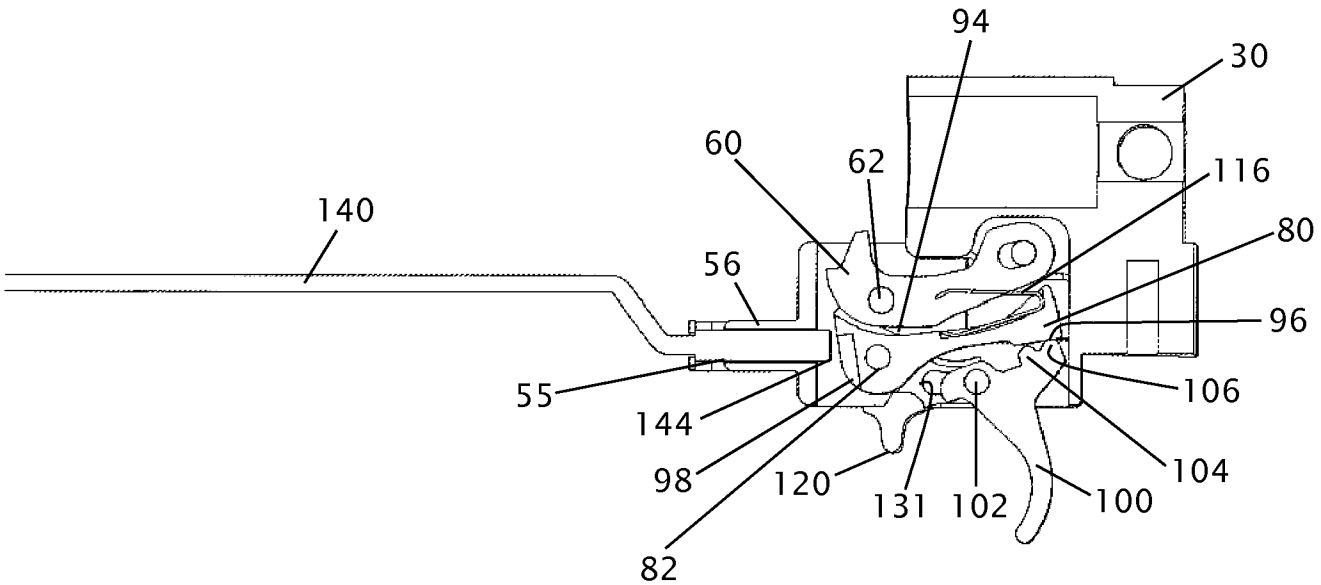
FIG. 8 is a cross sectional view of the trigger assembly of FIG. 7 taken along lines parallel to a longitudinal axis of the barrel of the airgun, wherein the gas piston has been omitted for clarity.
Figure 9:
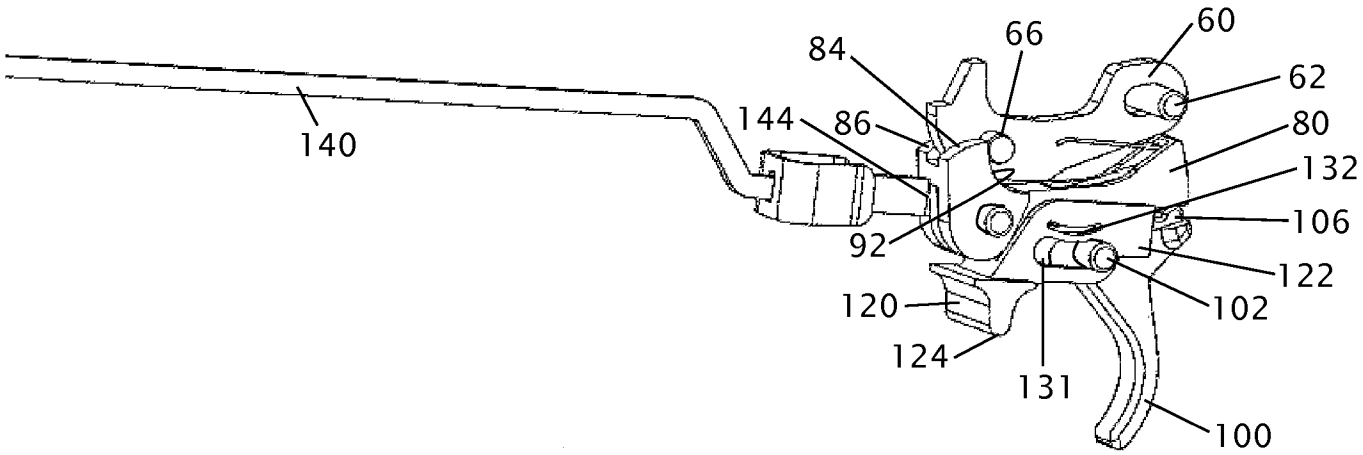
FIG. 9 is a perspective view of a primary sear and a secondary sear and the interlock of trigger assembly of FIG. 7, wherein the housing and gas spring have been omitted for clarity.

In the break barrel airgun, the barrel 12 is pivotally mounted relative to the receiver 14. The pivotal mounting exposes a breach and creates a lever arm for the user to cock the airgun so as to impart energy to a spring 16 (mechanical or gas) seen in FIGS. 3 and 7 which provides the motive force to propel a pellet. Typically, a piston (not shown) is driven by the spring 16 releasing the stored energy.

Typically, as the break barrel airgun is moved through a cocking cycle, a linkage having a lever, as known in the art acts, against the piston or directly upon the spring 16.

As the piston moves against the spring the piston is locked in position by a sear. When the airgun is fired, the piston is pushed forward at high velocity by the spring to compress the air in a chamber ahead of the piston. This high pressure air is restricted so that it can flow out of the chamber only against the pellet, which forces the pellet down the barrel.

The trigger assembly 20 includes a housing 30, a primary sear 60, a secondary sear 80, a trigger 100, a safety 120, wherein the secondary sear cooperates with an interlock 140.

Referring to FIG. 1, the interlock 140 is pivotally connected to a cocking strut 18 of a cocking linkage typically employed in the break barrel airgun 10.

Referring to FIGS. 2, 3, 5 and 7, the interlock 140 is a substantially planar member, wherein the plane of the interlock encompasses the longitudinal axis, or an extension of the longitudinal axis, of the barrel 12. The interlock 140 extends from a first end 142 connected to the cocking linkage to a second end 144. As the interlock 140 is a substantially planar member, the interlock can be formed from a single sheet of material without requiring secondary forming operations such as bending operations as required in prior art devices.

Figure 2:
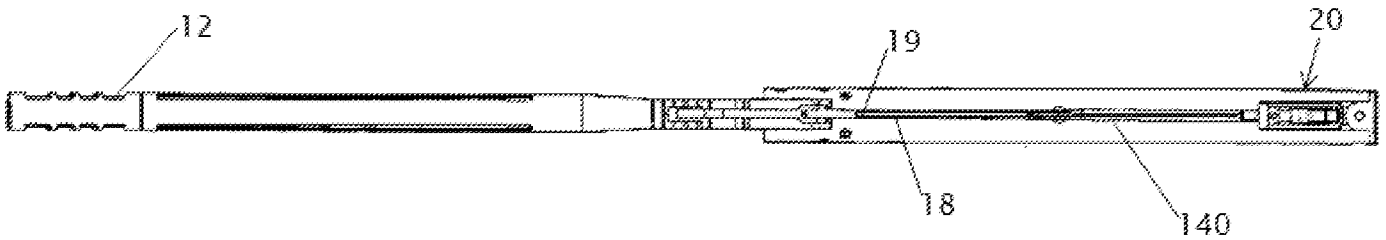
FIG. 2 is a bottom plan view of the barrel and trigger assembly of FIG. 1.

Referring to FIG. 2, the cocking strut 18 can include a central channel 19 or can be at least partly defined by a pair of parallel legs, wherein the interlock 140 is pivotally connected to the cocking strut and a portion of the interlock can pass between the parallel legs or within the central channel 19, thereby maintaining the plane of the interlock with the longitudinal axis of the barrel 12.

Figure 3:
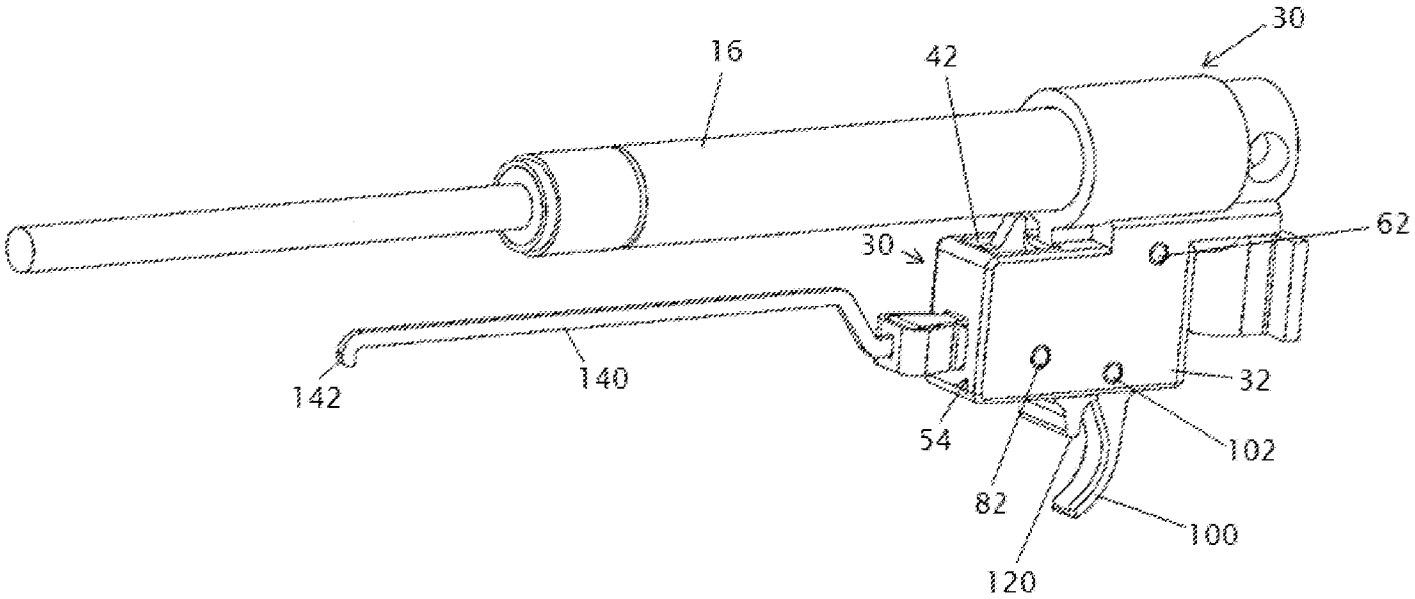
FIG. 3 is a perspective view of a portion of the assembly of FIG. 1 showing a configuration of the trigger assembly and interlock in a cocked configuration.

Referring to FIG. 3, the housing 30 includes first 32 and second opposing walls 42, such as sidewalls 32, 42 and an interconnecting wall 54.

Figure 4:
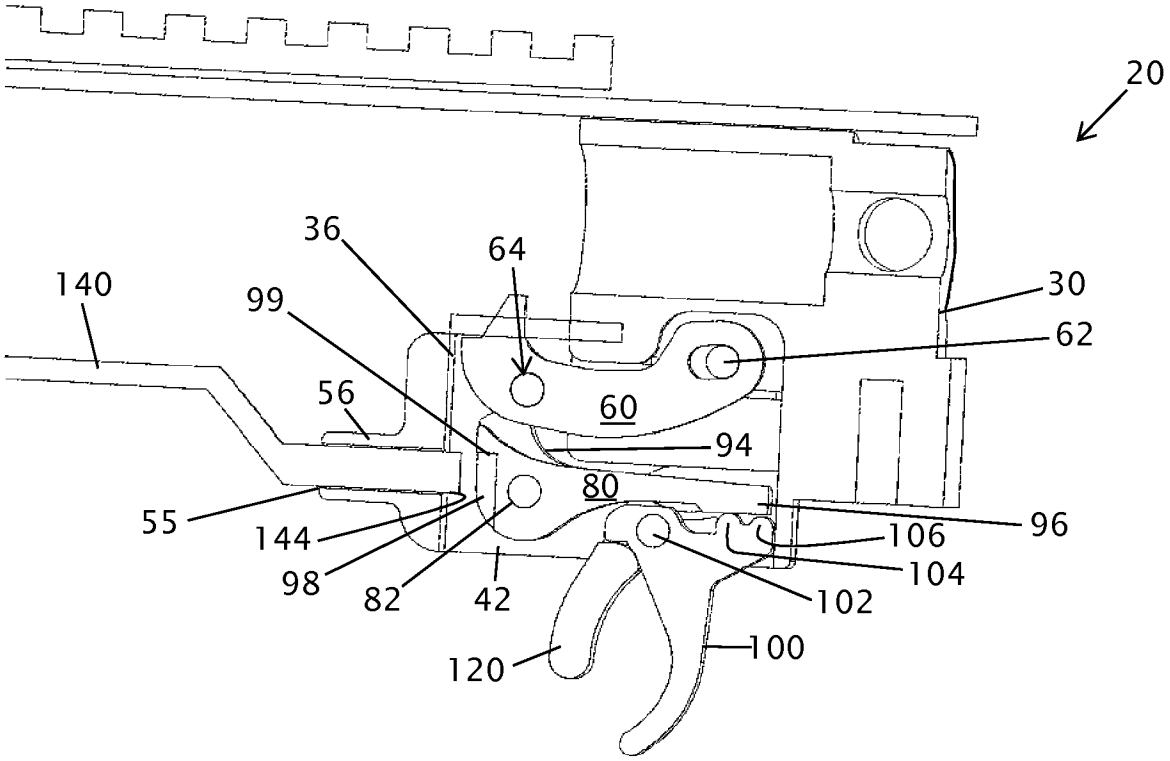
FIG. 4 is a cross sectional view of the trigger assembly of FIG. 1 taken along lines parallel to a longitudinal axis of the barrel of the airgun, wherein the gas piston has been omitted for clarity.

As seen in FIG. 4, in one configuration, the interconnecting wall 54 includes an aperture, cut away or port 55 through which a portion of the interlock 140 can pass. Further, the interconnecting wall 54 can include a guideway or boss 56 (extending about the port 55) for slideably receiving a portion of the interlock 140.

In a further configuration, the housing 30 includes a front wall 36 and a rear wall 46, each of these walls interconnecting the first and second opposing sidewalls 32, 42. In such configuration, the front wall 36 functions as the recited interconnecting wall 54.

Figure 11:
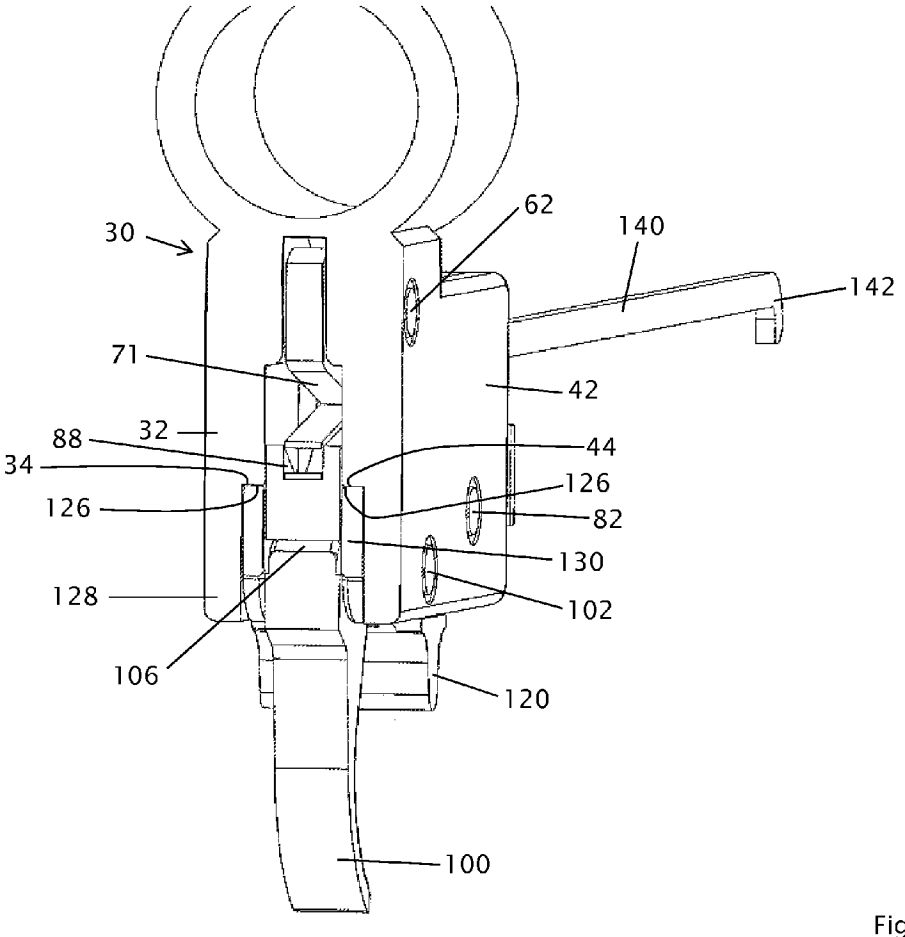
FIG. 11 is a rear perspective cross section perpendicular to the longitudinal axis of the assembly of FIG. 3.

The first and second opposing sidewalls 32, 42 include corresponding inner surfaces, wherein at least one, and in select configurations, the inner surface of each sidewall, as seen in FIG. 11, includes a shoulder 34, 44 extending a long a length parallel to the longitudinal axis. In one configuration, the housing is a substantially rigid molded, machined or welded piece, which can also include a seat for receiving a portion of the spring 116.

As seen in FIG. 4, the primary sear 60 is pivotally mounted to selectively engage a portion of the piston, as known in the art. The primary sear 60 is pivotally mounted relative to the housing 30 about a pin 62 so as to be movable between a cocked position and a fired position.

Figure 6:
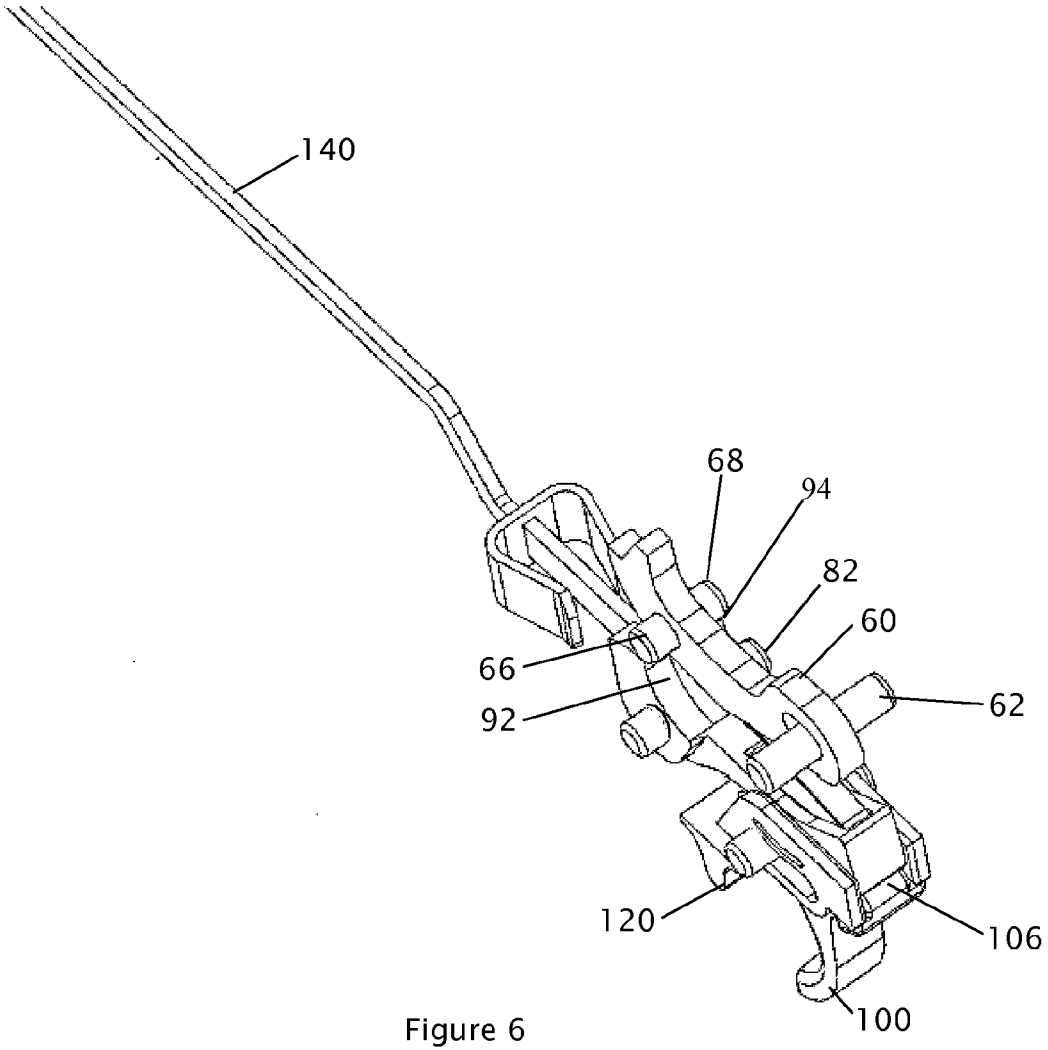
FIG. 6 is a top perspective view of the trigger assembly of FIG. 5.
Figure 10:
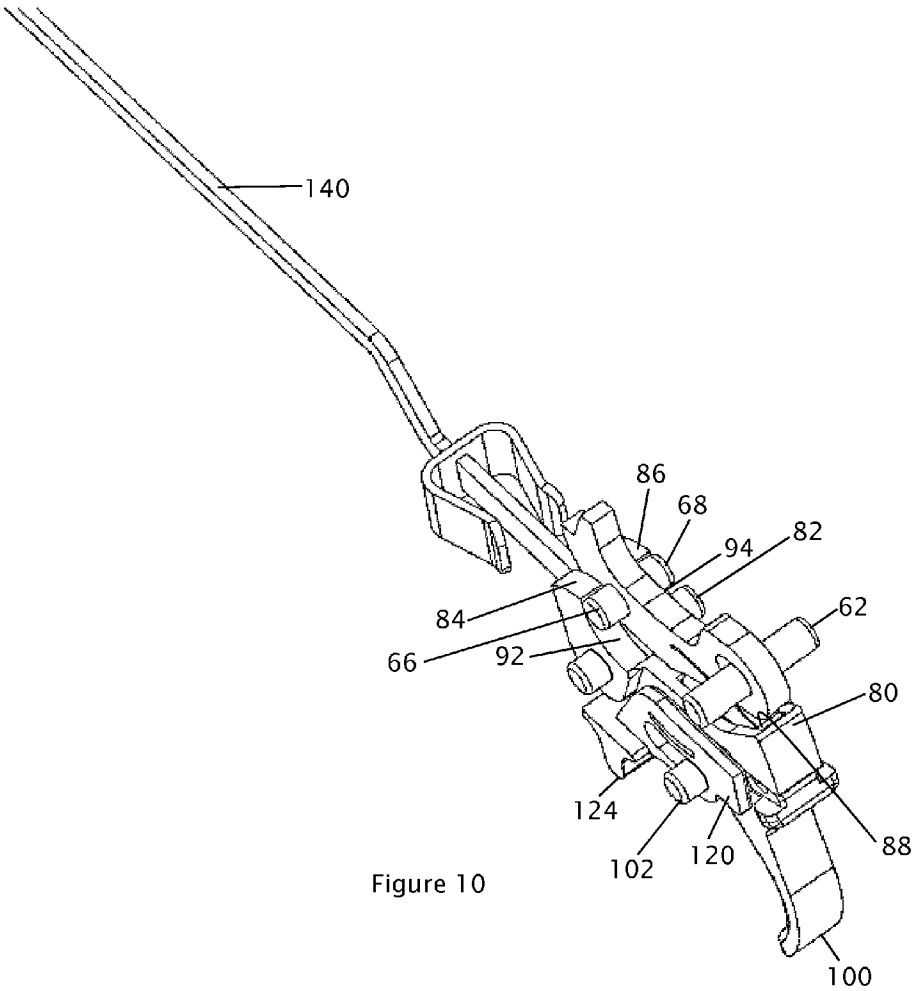
FIG. 10 is a top perspective view of the assembly of FIG. 9.

The primary sear 60 includes a cylindrical contact surface 64, and in select configurations, as seen in FIGS. 6 and 10, a first contact surface 66 and a spaced apart second contact surface 68.

As seen in FIGS. 5, 6, 9 and 10, the contact surfaces 66, 68 can be defined by substantially cylindrical member, wherein the cylindrical member can be either fixed relative to the primary sear or rotatably connected to the primary sear. That is, the contact surfaces can be formed by a cylindrical rod or pin, which rotates relative to the primary sear 60. Alternatively, such rod or pin can be fixed relative to the primary sear 60.

The secondary sear 80 is pivotally mounted relative to the housing 30 for movement between a safety position to a release position. The secondary sear 80 pivots about a pin 82, wherein the pin can extend into the opposing sidewalls 32, 42 of the housing 30.

The secondary sear 80 includes a first inflection surface 84 and a second inflection surface 86 which contact the primary sear 60, and specifically the first contact surface 66 and the second contact surface 68, respectively, in the cocked configuration of the trigger assembly.

The secondary sear 80 also includes a first guide surface 92 and a second guide surface 94 configured to cooperatively engage the first and second contact surfaces 66, 68 of the primary sear 60. In one configuration, the secondary sear 80 includes the first and second guide surfaces 92, 94 which are curvilinear, and in select configurations the curvilinear surfaces are concentric with the pivot pin 62 of the primary sear 60.

Further, the secondary sear 80 includes a contact area 96 for engaging the trigger 100, where the contact area is spaced from the pivot on the pin 82 of the secondary sear.

The secondary sear 80 includes a central pocket, socket or catch 98 having a shoulder or tab 99 for engaging the interlock 140 upon the interlock being disposed in a cocking or interlocked position.

A bias member 116, such as a spring, urges the primary sear 60 to the cocked position and the secondary sear 80 to the safety position. The spring 116 can be operably located between the primary sear 60 and the secondary sear 80 urging each to rotate about the corresponding pivot. For example, the secondary sear 80 can include a seat 88 for engaging and retaining the spring 116 relative to the sear. The primary sear 60 can include a guideway or a groove 71 sized to engage a portion of the spring 116.

The trigger 100 is pivotally connected to the housing 30 and movable through a firing range of motion. The trigger 100 is pivotally mounted by a pin 102 relative to the housing 30.

The trigger 100 includes a first actuating surface 104 and a spaced second actuating surface 106, where in a first actuating surface and the second actuating surface are located at a different radius from the pivot or axis of rotation of the trigger. In addition, the first actuating surface 104 has a different height than the second actuating surface 106, so that at least a temporal majority of the contact between the trigger 100 and the contact area 96 of the secondary sear 80 is defined by a single one of the actuating surfaces, rather than the actuating surfaces simultaneously contacting the contact area. That is, between 21% to 49% of the contact between the trigger 100 and the secondary sear 80 can be made by the second activity surface 106 and the contact area. Thus, approximately 2% to 49% can be by simultaneous contact of the first and second actuating surface 104, 106 and the secondary sear 80. Thus, the first actuating surface 104 and the second actuating surface 106 define different lever arms substantially independently acting upon the contact area 96 of the secondary sear 80. The adjustable height of at least one of the first actuating surface 104 and the second actuating surface 106 can be provided by interchangeable heads or tips of the surfaces (engaged by detents or fasteners) or the respective surface can be a portion of a threaded member which is selectively rotated to adjust the height and hence the trigger/firing characteristic of the assembly.

It is understood the relative amounts or ratios of first actuating surface contact range (with the secondary sear) to second actuating surface contact range (with the secondary sear) can range from approximately 1:50 to 50:1, and likely between approximately 1:20 to 20:1. That is, depending on the desired operating characteristics of the trigger assembly, the first actuating surface can contact the secondary sear for approximately 5% of the motion of the trigger (or secondary sear) to approximately 95%. Further, it is contemplated the amount of simultaneous contact of the first actuating surface and the second actuating surface with the secondary sear can be set or adjusted to be from approximately 1% to 99% of the amount or range of contacting motion between the trigger and the secondary sear, or of the range of motion of the trigger or the secondary sear. Thus, for example the first actuating surface can contact the secondary sear for approximately 50% to 70% of the available range of trigger (or secondary sear) motion, both the first and second actuating surfaces simultaneously contact the secondary sear for approximately 0.1% to 10% and then only the second actuating surface contacts the secondary sear for the remaining approximately 50% to 20%. Also, the first and second actuating surfaces can be configured to provide a relatively smooth or indistinguishable transition between the contact of each and the secondary sear, or the transition can be a significant, material change is resistance, thereby providing the user with sensory feedback corresponding to the amount of trigger travel remaining before firing of the gun. For example, the difference in resistance can range from approximately $1/10^{th}$ of a pound to approximately 15 pounds and typically between 0.5 pounds and 5 pounds.

The trigger assembly 10 further includes the safety 120, wherein the safety is movable between a safety position in a firing position. The safety 120 includes a main body 122 and a projecting arm 124, wherein the arm is configured to engage the user so as to move the safety from the safety position through the firing position. The main body 122 includes edges or surfaces 126 for engaging the shoulders 44 of the first and second opposing sidewalls 32, 42 of the housing 30, wherein the engagement of the main body and the shoulders of the housing provides guide surfaces for controlling movement of the safety 120 between the safety position in the firing position.

The main body 122 of the safety 120 can include first and second spaced apart sidewalls 128, 130 wherein at least one of the sidewalls includes an elongate slot 131 having a varying cross-section and a spaced biasing slot 133, wherein the elongate slot and the biasing slot are separated by a bridge 132. The elongate slot 131 is sized to have a dimension at each end that is substantially equal to the diameter of the pin 102 and an intermediate portion of the elongate slot having a dimension that is between approximately 60% to 99% of the dimension of the pin.

The bridge 132 is selected to flex in response to the pin 102 passing from a first end of the elongate slot 131 to a second end of the elongate slot.

In one configuration, the pin 102 is an extension of the pivot of the trigger. The flexing of the bridge 132 during movement of the safety 120 from the safety position to the firing position, provides positive feedback to the user as well as resisting movement of the safety from the position to which the user is disposed the safety. That is, a sufficient force must be applied to the safety 120 to flex the bridge 132 by virtue of the pin 102 passing the constricted portion of the elongate slot 131 so as to move the safety between the safety position in the firing position.

Figure 5:
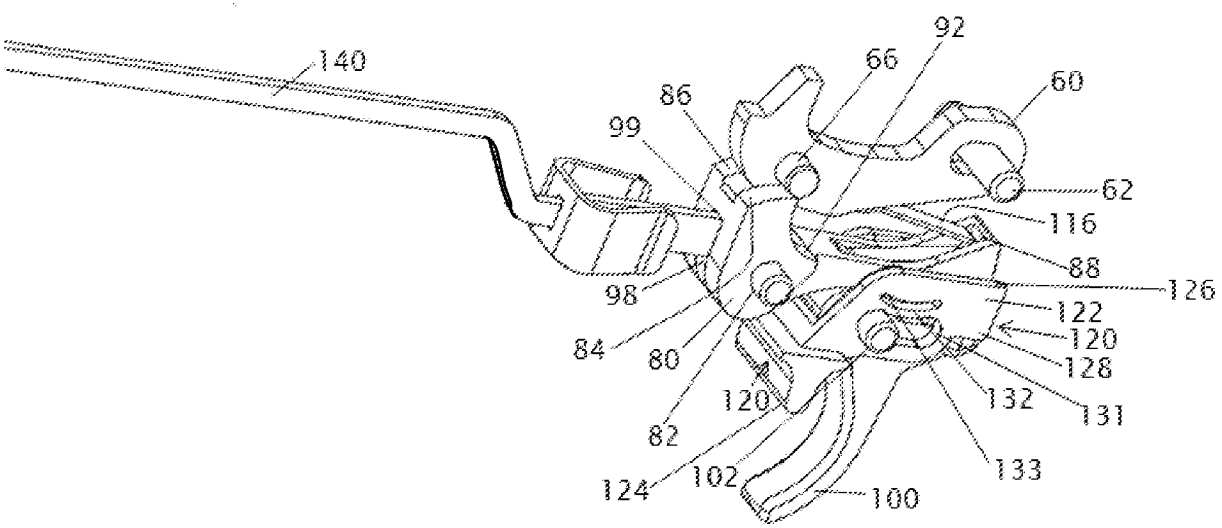
FIG. 5 is a perspective view of a primary sear and a secondary sear and the interlock of the trigger assembly of FIG. 4, wherein the housing has been omitted for clarity.

During cocking of the gun 10, the cocking strut 18 is generally moved toward the trigger assembly 20 thereby causing the interlock 140 to move toward the trigger assembly and specifically the second end 144 of the interlock engages the secondary sear 80. As seen in FIG. 5, the interlock 140 engages the catch 98 and shoulder 99 of the secondary sear 80 and the interlock precludes rotation of the secondary sear about its pivot to the firing rotation.

Alternatively, if the secondary sear 80 is slightly rotated about its pivot, then during cocking, the interlock 140 will engage the secondary sear and apply a force along a direction that does not pass through the pivot (pin 82) of the secondary sear, thereby creating a lever arm tending to rotate the secondary sear to the safety position.

In operation, the barrel 12 and the receiver 14 are rotated so as to open the breach and permit introduction of a projectile (pellet) as well as imparting energy to the spring 16. As the barrel 12 is rotated, the interlock 140 is driven towards the secondary sear and engages the secondary sear 80 to either impart a rotational force on the secondary sear toward the safety position or engage the catch 98 and/or shoulder 99 to retain the secondary sear in the safety position.

As the interlock 140 is engaged with the secondary sear 80, force applied by the trigger 100, even if not counteracted by the safety 120, is resisted by the interlock to inhibit rotation of the secondary sear or movement of the secondary sear from the safety position to the release position.

In intended use, both the safety 120 and the interlock 140 inhibit movement of the secondary sear 80 from the safety position to the release position during the cocking of the airgun 10.

Upon completion of the cocking, the cocking strut 18 is drawn toward a muzzle of the barrel 12 thereby imparting a corresponding motion on the interlock 140 toward the muzzle and away from the trigger assembly 20. This motion of the interlock 140 disengages the interlock from the secondary sear 80.

In the cocked configuration of the trigger assembly 20, seen in FIGS. 3-6, the first and second contact surfaces 66, 68 of the primary sear 60 engage the corresponding first inflection surface 84 and the second inflection surface 86 of the secondary sear 80.

Further, the safety 120 is in the safety position, wherein the pin such as the extension of the pivot pin 102 for the trigger 100 is located at a forward position of the elongate slot 131 and the bridge 132 resists movement of the safety relative to the pin.

The first actuating surface 104 of the trigger 100, defining the shorter lever arm, contacts the contact area 96 of the secondary sear 80. The primary sear 60 engages the piston as known in the art.

As the user imparts a force against the arm 124 of the safety 120, the bridge 132 is flexed and the pin 102 passes from the muzzle end to the butt end of the elongate slot 131 by flexing the bridge 132 and rotation of the trigger 100 is permitted.

As the user then imparts a force upon the trigger 100, the trigger starts to rotate about pin 102 so as to rotate the secondary sear 80 about the corresponding pivot point (pin 82), with the first actuating surface 104 of the trigger acting upon the contact area 96 of the secondary sear.

After rotation of the trigger 100 through a predetermined range, the second actuating surface 106 of the trigger 100 initiates contact with the secondary sear 80 and the first actuating surface 104 is separated from the secondary sear. Thus, a second, different lever arm is mechanically defined between the trigger 100 and the secondary sear 80.

Further rotation of the trigger 100 causes the second actuating surface 106 to further rotate the secondary sear 80 such that the contact surface 66, 68 of the primary sear 60 moves from the inflection surfaces 84, 86 of the secondary sear to the curvilinear guide surfaces 92, 94 of the secondary sear. This releases the piston and the airgun is fired.

Specifically, the bias force imparted by the bias member 116 on the primary sear 60, causes the primary sear to rotate about its pivot and the first and second contact surface of the primary surface to ride against the curvilinear first corresponding first guide surface 92 and second guide surface 94 of the secondary sear 80, thereby moving the primary sear out of operable engagement with the piston and initiating the firing cycle of the airgun.

It is believed that by providing first and second contact surfaces 66, 68 on the primary sear 60 and corresponding first and second guide surfaces 92, 94 on the secondary sear 80 wherein the guide surfaces are curvilinear, the mechanical motion and corresponding sensory feedback of the trigger assembly 10 is a positive mechanical engagement.

Thus, the present disclosure provides the trigger assembly 20 having the primary sear 60 moveable between the cocked position and the fired position; the trigger 100 moveable through the firing motion; and the secondary sear 80 interconnecting the trigger and the primary sear, the secondary sear movable, in response to the trigger moving though the firing motion from the safety position to the release position, the release position of the secondary sear permitting movement of the primary sear from the cocked position to the fired position.

In a configuration of the trigger assembly 20, the secondary sear 80 rotates about the pivot 82 between the safety position and the release position. In further configurations, the contact surface 64 of the primary sear 60 is cylindrical for contacting the curvilinear guide surface 94 of the secondary sear 80 in response to the secondary sear moving to the release position. It is also contemplated the cylindrical contact surface 64 of the primary sear 60 is fixed relative to the primary sear for contacting the curvilinear guide surface 94, 96 of the secondary sear 80 in response to the primary sear moving from the cocked position to the fired position.

Alternatively, the cylindrical contact surface 64 of the primary sear 60 is moveable, such as rotatable relative to the primary sear, for contacting the curvilinear guide surface 94, 96 of the secondary sear 80 in response to the primary sear moving from the cocked position to the fired position. That is, the contact surface 64 is rotatable relative to a remaining portion of the primary sear 60.

Thus, the trigger assembly 20 can include or cooperatively engage the interlock 140, wherein the interlock selectively contacts the secondary sear 80. The interlock 140 can be planar. The interaction of the interlock 140 and the secondary sear 80 can include the interlock selectively contacting the secondary sear to urge the secondary sear to the safety position.

The primary sear 60 can include the first contact surface 66 for contacting the curvilinear first guide surface 94 of the secondary sear 80 in response to the primary sear moving from the cocked position to the fired position, the first contact surface being one of a molded surface and free of a molding part line.

Further, the primary sear 60 can include the first contact surface 66 for contacting the curvilinear first guide surface 94 of the secondary sear 80 in response to the primary sear moving from the cocked position to the fired position, the first guide surface being one of a molded surface and free of a molding part line.

Also, the primary sear 60 can include the first contact surface 66 and the spaced apart second contact surface 68 and the secondary sear 80 includes the first guide surface 92 and the second guide surface 94, the first contact surface contacting the first guide surface and the second contact surface contacting the second guide surface in response to the secondary sear moving from the safety position to the release position. It is contemplated the secondary sear 80 can include the curvilinear guide surface 92, 94 selectively contacting the primary sear 60, the curvilinear guide surface being concentric with the pivot point of the primary sear.

The trigger assembly 20 can include the primary sear 60 having the first contact surface 64 and the spaced apart second contact surface 66; and the secondary sear 80 having the first guide surface 92 and the spaced apart second guide surface 94, the first guide surface aligned with the first contact surface and the second guide surface aligned with the second contact surface.

In this configuration, the interlock 140 is moveable between the cocking position and the rest position, the interlock contacting the secondary sear 80 in the cocking position and being spaced from the secondary sear in the rest position. The secondary sear 80 is movable between the safety position and the release position and the interlock 140 in the cocking position urges the secondary sear to the safety position. Further, as the secondary sear 80 is movable between the safety position and the release position, the interlock 140 in the cocking position inhibits or restricts movement of the secondary sear to the release position. Also, the first contact surface 66 contacts the first guide surface 92 simultaneously with the second contact surface 68 contacting the second guide surface 94.

Further, a gun 10 is disclosed having the barrel 12 pivotally mounted to the receiver 14, the barrel moveable relative to the receiver between the cocking configuration and the firing configuration; the trigger assembly 20 in the receiver portion, the trigger assembly including the trigger 100 and the secondary sear 80, the secondary sear moveable between the safety position and the release position; and the interlock 140 connected to the barrel and moveable between (i) the interlocked cocking position in the cocking configuration of the barrel and the receiver, the interlock contacting the secondary sear in the interlocked position to at least one of (a) preclude (or inhibit) the firing movement of the secondary sear and (b) urge movement of the secondary sear to the safety position and, (ii) the shooting position in the firing position of the barrel portion and the receiver portion, the shooting position permitting movement of the secondary sear to the release position. As set forth above, the interlock 140 urges rotation of the secondary sear 80 to the safety position. The interlock 140 can be planar and vertically aligned with the center, or longitudinal axis, of the barrel 12.

The trigger assembly 20 includes the housing 30; the sear moveably connected to the housing, the sear 80 moveable between the safety position and the release position; and the trigger 100 connected to the housing to move through a firing range of motion, the trigger including the first actuating surface 104 and the spaced second actuating surface 106, the first actuating surface engaging the sear in the first portion of the firing range of motion and the second actuating surface engaging the sear in the second portion of the firing rotation of motion.

At least one of the first actuating surface 104 and the second actuating surface 106 is adjustable. That is, the relative amount of contact of the first and second actuating surface with the secondary sear 80 can be adjusted as changed by changing the relative heights of the actuating surfaces.

The trigger assembly 20 can be configured such that contact between the sear 80 and the first actuating surface 104 imparts a less resistance to motion of the trigger 100 than contact between the sear and the second actuating surface 106.

The trigger assembly 20 can include the housing having 30 first and second spaced opposing walls 32, 42 each wall including the shoulder 44; the trigger 100 rotatably connected relative to the housing; and the safety 120 having a main body

122 and a projecting arm 124, the main body having spaced sliding surfaces for engaging the corresponding shoulder of the housing.

The main body 122 of the safety 120 includes the elongate slot 131 having the varying cross section and the spaced biasing slot 133, the elongate slot and the biasing slot separated by the bridge 132, the bridge flexing in response to the pin 102 passing from the first end of the elongate slot to the second end of the elongate slot.

While the invention has been described in connection with several presently preferred embodiments thereof, those skilled in the art will appreciate that many modifications and changes may be made without departing from the true spirit and scope of the invention, which accordingly is intended to be defined solely by the appended claims.

The invention claimed is:

1. A trigger assembly comprising:

(a) a housing having first and second spaced opposing side walls;

(b) a trigger and a safety at least partially located between the opposing side walls;

(c) a primary sear and a secondary sear located between the opposing side walls, wherein the secondary sear rotates about a pivot between a safety position and a release position, the primary sear includes a first contact surface and a spaced apart second contact surface and the secondary sear includes a first guide surface and a second guide surface, the first contact surface contacting the first guide surface and the second contact surface contacting the second guide surface; and (d) an interlock, the interlock moveable between (i) an interlocked position contacting the secondary sear to at least one of (a) inhibit a firing movement of the secondary sear and (b) urge movement of the secondary sear to the safety position and (ii) a shooting position permitting movement of the secondary sear to the release position.

2. The trigger assembly of claim 1, wherein each of the first and second spaced opposing side walls includes a shoulder and the safety includes a main body and a projecting arm, the main body having spaced sliding surfaces for engaging the corresponding shoulders of the housing.

3. The trigger assembly of claim 1, wherein the safety includes a main body defining an elongate slot having a varying cross section and a spaced biasing slot, the elongate slot and the biasing slot separated by a bridge, the bridge flexing in response to a pin passing from a first end of the elongate slot to a second end of the elongate slot.

4. The trigger assembly of claim 1, further comprising a connecting wall interconnecting the first and second spaced opposing side walls.

5. The trigger assembly of claim 1, wherein the first contact surface and the second contact surface of the primary sear are cylindrical.

6. The trigger assembly of claim 1, wherein the first guide surface and the second guide surface of the secondary sear are curvilinear.

7. The trigger assembly of claim 1, wherein the first contact surface and the second contact surface of the primary sear are cylindrical and fixed with respect to a remaining portion of the primary sear.

8. The trigger assembly of claim 1, wherein the housing is connected to a gun having a barrel and the interlock is parallel to the barrel.

9. The trigger assembly of claim 1, wherein the interlock extends between the opposing sidewalls.

* * * * *